United States Patent [19]

Lueth

[11] 4,398,702

[45] Aug. 16, 1983

[54] METALLURGICAL FURNACE

[75] Inventor: Roy C. Lueth, St. Clair, Mich.

[73] Assignee: Ultra-Temp Corporation, Sterling Hgts., Mich.

[21] Appl. No.: 360,337

[22] Filed: Mar. 22, 1982

[51] Int. Cl.[3] ..... C22B 60/04

[52] U.S. Cl. ..... 266/208; 266/207

[58] Field of Search ..... 266/207, 208, 209, 210, 266/211, 283, 286; 75/252, 256, 221, 224

[56] References Cited

U.S. PATENT DOCUMENTS

| | | | |
|---|---|---|---|
| 2,293,089 | 8/1942 | Wainer | 266/286 |
| 2,756,138 | 7/1956 | Meister | 266/208 |
| 2,771,357 | 11/1956 | Wroughton | 266/208 |
| 3,915,695 | 10/1975 | Hulsey | 266/207 |

*Primary Examiner*—L. Dewayne Rutledge
*Assistant Examiner*—Scott Kastler
*Attorney, Agent, or Firm*—Gifford, Van Ophem, Sheridan & Sprinkle

[57] ABSTRACT

A metallurgical furnace is disclosed which carries out the several steps involved in the liquid phase sintering of preforms of powdered metals, ceramics, and/or combinations of these materials. The metallurgical furnace comprises a pressure vessel defining an interior pressure chamber and a main furnace which is contained within the pressure chamber and spaced inwardly from the walls of the pressure vessel. The main furnace comprises a bottom wall, side walls, top wall and end walls which together form a substantially closed furnace chamber. Each of these furnace walls comprises at least one layer of insulation and, in addition, the top, sides, and end walls further include a vapor barrier which minimizes convection within the furnace chamber. The metallurgical furnace according to the present invention is capable of performing the presinter, sinter and hot isostatic pressing of preforms within the furnace chamber.

14 Claims, 4 Drawing Figures

METALLURGICAL FURNACE

BACKGROUND OF THE INVENTION

I. Field of the Invention

The present invention relates to a metallurgical furnace for liquid phase sintering of preforms of powdered metals, ceramics, and the like.

II. Description of the Prior Art

In the liquid phase sintering of preforms of powdered metals, ceramics, and the like, the preforms are sequentially subjected to a presinter step, a sinter step and at times a hot isostatic pressing (HIP). Each of these steps is discussed separately below.

The presinter step is used primarily to remove the fugitive binder or "wax" which holds the part which is constructed of the powdered material in the desired shape after cold pressing. Usually this fugitive binder consists of a paraffin, polyetheleneglycol or a metal containing a hydrocarbon. The presinter step is also known as the "dewax" step.

During the presintering step, the cold pressed parts are slowly raised through the vaporization temperature of the various molecular weight constituents of the hydrocarbons used in the fugitive binder. As these various constituents are vaporized, they are evacuated from the furnace and thus from the parts by a wash gas, such as hydrogen, or removed by vacuum pumping. When vacuum pumping is used to remove the vapors of the fugitive binder, a condensation means is provided between the furnace and the vacuum pump to prevent the wax vapors from entering and possibly damaging the vacuum pump.

During the presinter operation, the vapors of the fugitive binder, or wax vapors, must be removed from the furnace before the "cracking" temperatures of the various hydrocarbon constituents of the wax vapors are reached. Otherwise, if cracking should occur, carbon deposits on and is absorbed by the parts. Carbon deposits, in the later sintering operation, can cause undesirable carbon changes in the parts.

The final temperature that the parts are subjected to during the presinter operation is approximately 400° C.

In the previously known vacuum furnaces capable of presintering, relatively thin and porous insulation is provided around the furnace chamber, i.e., the chamber in which the parts are processed. The furnace chamber, in turn, is contained within a pressure and/or vacuum vessel (hereinafter collectively referred to as a pressure vessel). This relatively thin insulation is designed so that the outside of the insulation becomes sufficiently heated to prevent condensation of the wax vapors on the outside of the insulation. Otherwise, during the sintering operation, these wax vapors will revaporize and contaminate the parts.

There have been previously known furnaces which perform both the presinter and sintering steps or operations. by raising the temperature of the furnace to about 1,200°-2,000° C. following the dewax step. In one type of previously known stoking furnaces, a flowing cover gas, such as hydrogen, is continually supplied to the furnace chamber, while in another type of previously known furnace, the furnace chamber is evacuated during the sintering operation. The parts are kept within the furnace chamber for a sufficient time for the parts to obtain proper densification and microstructural development. If the porosity levels of the parts are acceptable following the sintering operation, the parts can be then finished and used.

Since these previously known furnaces which perform both the presinter and sinter operations use relatively thin and porous insulation around the furnace chamber in order to prevent wax condensation on the insulation during the presinter step, a great amount of heat loss from the furnace chamber occurs during the sintering operation in view of the higher temperatures required during sintering. Such large heat losses not only result in high power consumption from the furnace heating elements but also necessitates large cooling requirements for the cooling of the pressure vessel surrounding the furnace chamber.

Following the sintering step, the parts are subjected to HIP processing if further densification of the parts is required. In HIP processing, the parts are loaded into graphite containers and placed within the furnace chamber of the HIP equipment. The furnace chamber is then evacuated and, while still cold, pressurized to approximately 5,000 psi with an inert gas, such as argon. The temperature of the furnace compartment is then raised to the liquid phase region of the parts, typically 1,200°-1,500° C., and the thermal expansion of the argon gas increases the pressure to approximately 10,000-15,000 psi. Under these conditions, porosity and voids within the parts are effectively closed.

Due to the high temperatures and pressures used during HIP processing, the previously known HIP equipment is extremely massive in construction and expensive to acquire. Although the HIP equipment could be used to both perform the sintering step and HIP step, HIP equipment is not designed for and, therefore, cannot be used to dewax the preforms, i.e., perform the presintering step. For example, HIP equipment does not include means for condensing or collecting wax from the preforms. In any event, it would not be cost effective to perform the presintering step in the HIP equipment since presintered parts occupy approximately twice the volume of sintered parts so that the capacity of the HIP equipment would not be effectively used.

In a still further type of metallurgical sinter furnace, the outside walls of the furnace are directly cooled by a water jacket. This furnace cannot be used to perform the dewax step since, during sinter, the wax would revaporize and contaminate the parts.

None of the previously known metallurgical furnaces have been capable of performing the presinter, sintering and HIP processing within a single furnace chamber. Consequently, the parts must necessarily be transferred between at least two and usually three separate furnaces or furnace chambers in order for the entire processing of the part from presinter and through the HIP to be completed. Since the parts must usually be cooled to room temperature before such transfers any dissolved contaminants, such as oxygen, calcium, sulpher and the like, can collect in any porosity or voids in the parts. Such contaminants may require a higher pressure in the HIP step in order to reduce porosity and close voids in the parts. Furthermore, the previously known furnaces which use hydrogen are prone to explosions which presents a safety hazard.

SUMMARY OF THE PRESENT INVENTION

The present invention provides a device to effectively perform the presinter, sintering and the equivalent of HIP processing within a single furnace chamber.

In brief, the metallurgical furnace according to the present invention comprises a pressure vessel which defines an interior pressure chamber. A main furnace is contained within the pressure chamber and is spaced inwardly from the walls of the pressure vessel. The furnace chamber comprises a bottom wall, side walls, top wall, and end walls which, together, form a substantially closed furnace chamber. A door provides access to the furnace chamber for the introduction and removal of parts.

Each furnace wall comprises at least one layer of porous thermal insulating material and at least the bottom furnace wall is porous in construction. In addition, each furnace wall except for the bottom wall includes a vapor barrier and, in the preferred form of the invention, the vapor barrier is sandwiched in between two layers of insulation. The insulation used is relatively thick, i.e., high thermal insulating capability, in comparison with the previously known presinter furnaces.

Conventional heating elements are positioned within the furnace chamber to heat the furnace chamber to the required temperatures. In addition, a vacuum pump is connected to the pressure vessel for evacuating both the pressure vessel and furnace chamber through the bottom wall of the furnace. A hydrogen distribution tube is also contained directly within the furnace chamber for supplying hydrogen or other wash gas directly to the furnace chamber during the presinter or "dewax" step. A water cooling jacket is also secured in contact with the pressure vessel for cooling and/or heating the pressure vessel.

During the processing of the preforms of powdered metals, ceramics, or the like the preforms are loaded into a carrier which is placed within the furnace chamber through a furnace access door and the access door is closed. A hatch is then fluidly sealed to the pressure vessel. During the presinter or dewax step, the pressure vessel is first evacuated and temperature of the furnace chamber is then gradually raised from room temperature and to its upper limit of about 400° C. Preferably, a wash gas such as hydrogen is introduced directly into the furnace chamber during the dewax step, but, alternatively, vacuum dewaxing can be used. The vapor barrier in the top, sides and end walls of the furnace substantially prevents the hydrogen gas from passing through these walls but the hydrogen gas does flow freely through the bottom furnace wall and into the pressure chamber, i.e., the area between the pressure vessel walls and the walls of the furnace. Above a predetermined and relatively low pressure, for example 2–3 psi, a valve fluidly connected to the pressure chamber opens and the excess hydrogen as well as any wax vapors entrained in the hydrogen is ignited and burned off.

As the temperature of the furnace compartment raises, the fugitive binder or wax vaporizes and is carried away from the furnace chamber through its bottom wall by the wash gas. The vaporized wax is both combusted with the hydrogen at the burn off valve as well as condensed on the inside of the pressure vessel walls. The outside of the furnace walls, however, are maintained at a temperature greater than the condensation temperature of the wax vapors at the end of the dewax cycle to prevent any accumulation of wax on the outside of the furnace walls. Although the heating of the outside of the furnace walls is preferably accomplished by the thermal conductivity of hydrogen gas present in the furnace chamber and the pressure vessel, other means, such as auxiliary heaters can alternatively be used. This is particularly true if vacuum dewaxing is employed in lieu of the hydrogen wash gas.

Following the dewax step, the pressure and furnace chambers are evacuated and, at the same time, the pressure vessel walls are further cooled by the water jacket in order to solidify any wax on the walls of the pressure vessel. After the pressure and furnace chambers have been evacuated, the temperature of the furnace chamber is raised to remove absorbed gases and finally raised to the sintering temperature of the metal and maintained at that temperature for the period necessary to obtain the desired microstructure and densification of the parts. Such high temperatures necessary for the sintering process can be easily obtained due to the relatively thick insulation used as the furnace walls.

Following the sintering step and with the parts in an elevated temperature, an inert gas, such as argon, is introduced to the pressure vessel until an internal pressure of about 50–1,000 psi is obtained. In practice, it has been found that this relatively low pressure, in comparison with the HIP process, is sufficient to obtain nearly 100% theoretical density of the parts.

The present invention thus achieves the presinter, sintering and HIP processing of the parts within a single furnace of a single device. The present invention, in addition to rapid metallurgical processing, completely eliminates the possibility of contamination of the parts during transfer of the parts from one furnace chamber and to another.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
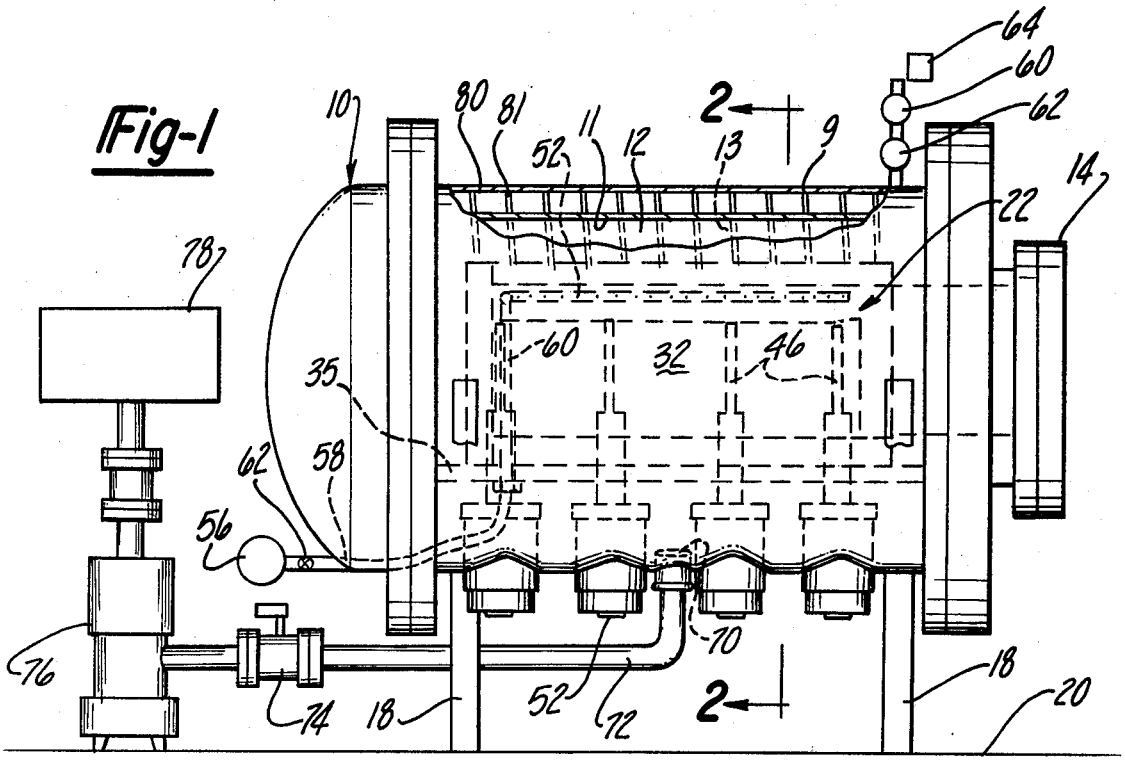
FIG. 1 is a fragmentary side view illustrating a preferred embodiment of the device according to the present invention.
Figure 2:
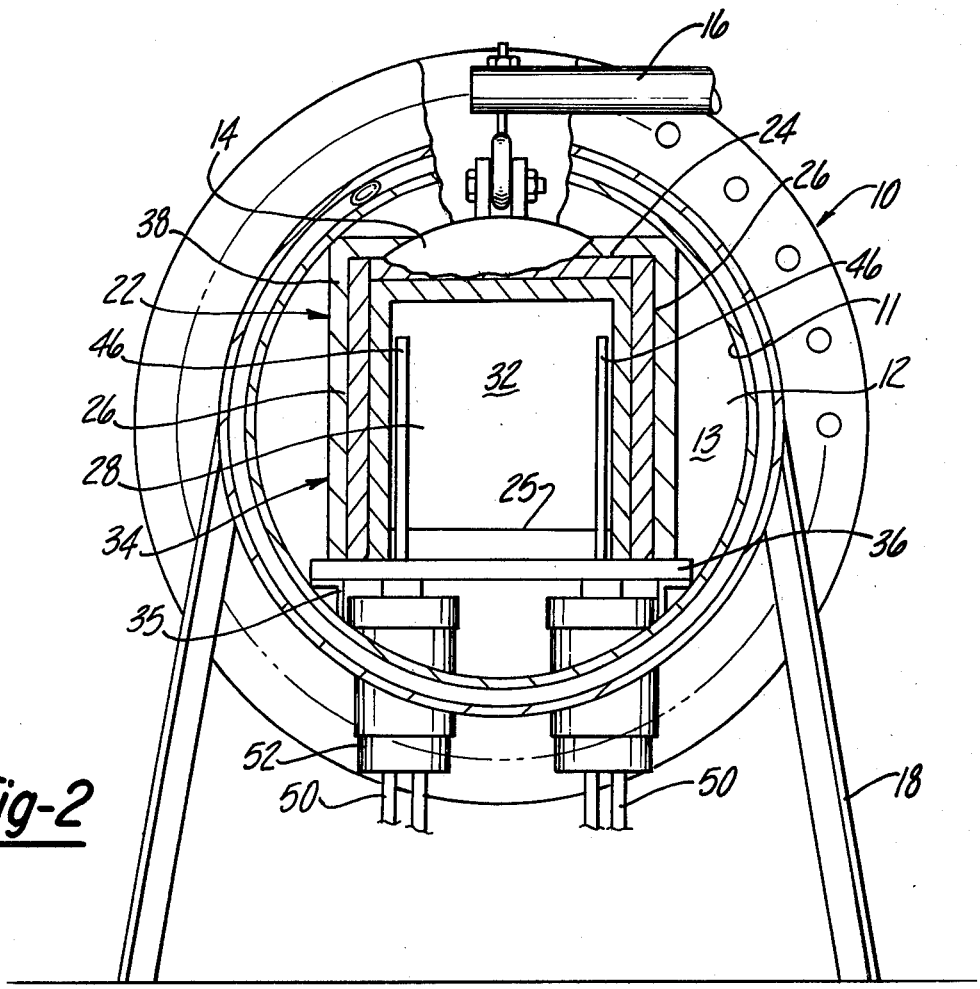
FIG. 2 is a cross sectional view illustrating the preferred embodiment of my device.

With reference to FIGS. 1 and 2, a preferred embodiment of the metallurgical furnace according to the present invention is thereshown and comprises a generally cylindrical pressure vessel 10 having inside walls 11 which define an interior and generally cylindrical pressure chamber 12. Appropriate fluid seals (not shown) are used throughout the pressure vessel 10 which eliminate all fluid leakage from the pressure chamber 12 and exteriorly of the vessel 10. In addition, an access door 14 is swivelly mounted by a pivot arm 16 to one end of the vessel 10 to provide access into the pressure chamber 12. Any conventional means, such as support legs 18, are used to support the pressure vessel 10 upwardly from the ground support surface 20.

Figure 3:
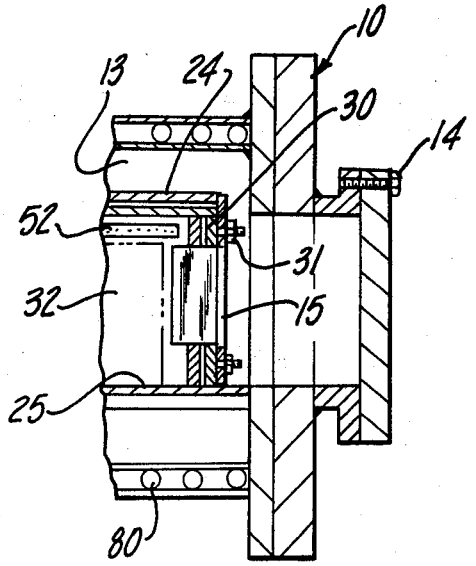
FIG. 3 is a fragmentary sectional view showing a portion of my device.
Figure 4:
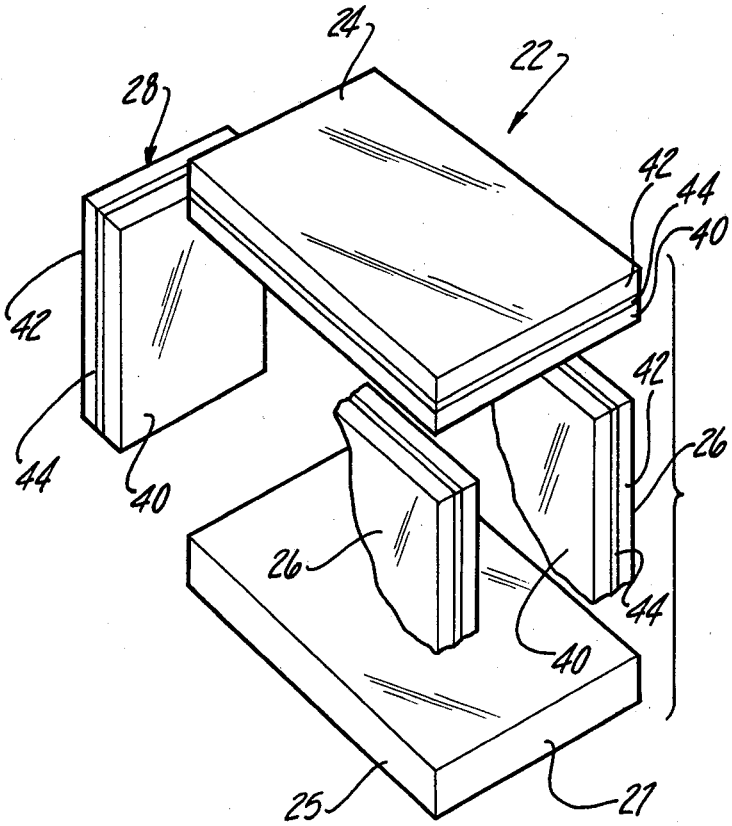
FIG. 4 is an exploded, diagrammatic view showing a different portion of my device.

With reference now particularly to FIGS. 1, 2 and 4, a main furnace 22 is contained within the interior chamber 12 of the pressure vessel 10. The furnace 22 is spaced inwardly from the walls 11 of the pressure vessel 10 thus forming a subchamber 13 therebetween. Preferably, the furnace 22 is generally rectangular in shape thus having a top wall 24, a bottom wall 25, side walls 26 a rear end wall 28 and a front wall 30. The front wall 30 is preferably attached directly across the front of the furnace (FIG. 3) and secured in place by bolts 31. The furnace walls 24–30 form a generally rectangular furnace chamber 32.

As best shown in FIGS. 1 and 2, the main furnace 22 is secured within the pressure chamber 12 by a frame 34 which is secured directly to the pressure vessel 10. In the preferred form of the invention, the frame 34 comprises a pair of axially extending angle supports 35 secured to the inside walls 11 of the pressure vessel 10 and a plurality of axially spaced cross bars 36 secured between the angle supports 35. The bottom wall 25 of the furnace 22 rests directly upon the cross bars 36. Axially spaced encircling bands 38 (only one shown) are secured to each cross bar 36 and each band 38 extends around the side walls 26 and top wall 24 of the furnace 22 to rigidly secure the furnace 22 to the pressure vessel 10. Other means, however, can alternatively be used to secure the furnace 22 to the pressure vessel 10.

With reference now to FIG. 4, the side walls 26, top wall 24 and end walls 28 and 30 each comprise at least one and preferably an inner layer 40 and outer layer 42 of porous thermal insulation. A vapor barrier 44 which is substantially impervious to the passage of gases is sandwiched in between the inner and outer insulation layers 40 and 42 for a reason to be subsequently described. The thermal insulation layers 40 and 42 are each preferably constructed from a graphite fiber foam while the vapor barrier 44 is preferably constructed from a graphite fiberous material. Such material is currently available under the trademark "Grafoil" from Fiber Form, Inc. Moreover, the thermal insulating capability of the insulation layers 40 and 42 is much greater than the previously known presinter furnace.

Unlike the side, top and end furnace walls, the bottom wall 25 of the furnace is constructed only from one or more layers 47 of porous thermal insulating material and, thus, does not include a vapor barrier. The reason for this construction of the bottom furnace wall 25 will be subsequently described in greater detail.

With reference to FIGS. 1 and 2, a plurality of electrical heating elements 46 are disposed within the furnace chamber 32 at axially spaced positions and at opposite sides therealong. These heating elements 46 are conventional in construction and are connected to a source of electrical power 48 (illustrated diagrammatically) by electrical power lines 50. Fluid tight fittings 52 extend around the power lines 48 at their passage through the walls 11 of the pressure vessel 10 to prevent any fluid leakage between the pressure chamber 12 and exteriorly of the pressure vessel 10 along the electrical power lines.

With reference now particularly to FIG. 1, an elongated gas distribution tube 52 is secured axially along the furnace chamber 32 adjacent its top wall 24. This tube 52 includes a plurality of axially spaced ports formed through it and is connected at one end to a source 56 of wash gas, such as hydrogen, by interconnecting conduits 58 and 60. A valve 62 is disposed in series with the conduit 58 so that, upon opening, wash gas from the source 56 flows through the interconnecting conduits 58 and 60, into the distribution tube 52 and into the furnace chamber 32 through the ports 54.

With reference now to FIG. 1, a pressure responsive valve 60 is secured to the top of the pressure vessel 10 so that its inlet is open to the pressure chamber 12 through a shut off valve 62 while its outlet is open outside of the vessel 10. The valve 60 is designed so that, when the shut off valve 62 is open, the pressure responsive valve 60 opens whenever the pressure in the pressure chamber 12 exceeds a predetermined amount, such as 2–3 psi. In addtion, an ignitor 64 is operatively positioned adjacent the outlet of the pressure responsive valve 60 and pressure responsive means 65 automatically activate the igniter 64 whenever the valve 60 is open to ignite the vapors exhausted out through the outlet of the valve 60.

Still referring to FIG. 1, an opening 70 formed in the bottom of the pressure vessel 10 is connected by a vacuum line 72 to one end of a vacuum shut off valve 74. The outlet from the vacuum shut off valve 74 is connected through a condensation means 76 and to a vacuum pump 78. The condensation means 76 is conventional in construction and serves to condense any vapors contained within the gas flow from the pressure vessel 12 and to the vacuum pump 78 in order to protect the vacuum pump 78 from damage.

With reference still to FIG. 1, a water cooled jacket 80 in the form of a helical water channel 81 is formed between the inner wall 11 and an outer wall 9 of the pressure vessel 10 and thus in contact with the interior walls 11 of the pressure vessel 10. Consequently, the temperature of the pressure vessel 10 can be controlled by controlling the temperature of the water in the water jacket 80 for a reason to be subsequently described.

In operation, the device according to the present invention can be used to perform the presintering, sintering and the equivalent of the HIP process on preforms of powdered metal, ceramics, or the like. As previously set forth, such parts are mixed with a fugitive binder or wax and cold pressed into the desired shape. This fugitive binder usually consists of a paraffin, polyethelengeglycol or a metal containing a hydrocarbon.

In operation, a carriage (not shown) containing the preforms is first positioned within the furnace chamber 32. The front wall 30 is then secured in place by bolts 31 (FIG. 3) and the access door 14 is closed and sealed, as shown in solid line in FIG. 3, to the pressure vessel 10 by any conventional means. After the access door 14 is closed, the front wall 30 of the furnace abuts against its adjacent side walls 26, top wall 24 and bottom wall 25 thus effectively closing the furnace chamber 32 with the preforms contained within the furnace chamber 32.

The pressure chamber 12 as well as the furnace chamber 32 is then evacuated by the vacuum pump 78 which removes most of the contaminants contained within the pressure chamber 12. Following evacuation, the vacuum pump shut off valve 74 is closed and the wash gas from the source 56 is supplied directly to the furnace chamber 32 through the distribution tube 52.

Simultaneously, the heating elements are energized and gradually increase the temperature within the furnace chamber 32 in order to gradually vaporize the wax. The vapor barrier 44 in the side, top and end walls 26, 24 and 28 of the furnace 22 forces the wash gas as well as wax vapors entrained within the wash gas downwardly through the bottom wall 25 of the furnace and into the subchamber 13. Furthermore, the wash gas which is lighter in weight than the vaporized wax and this aids in forcing the wax downwardly through the bottom wall 25 of the furnace 22 and into the subchamber 13 between the walls of the pressure vessel 10 and the outside of the furnace walls 24–30.

As described above, the vapor barrier in the top wall 24, side walls 26 and end walls 28 and 30 prevents the wax and hydrogen from flowing outwardly through these side, top and end walls. At the same time, the water jacket 88 maintains the pressure vessel 10 at a temperature below the vaporization point but above the solidification point of the wax so that a portion of the vaporized wax condenses against the interior of the pressure vessel 10 and flows downwardly towards the opening 70 in the bottom of the vessel 10.

During the dewax or presinter step, the shut off valve 62 to the pressure responsive 70 is opened so that when the pressure within the pressure chamber 12 exceeds a predetermined amount, such as 2–3 psi, the pressure responsive valve 60 opens and exhausts both the wash gas and any vaporized wax entrained in the wash gas out through the outlet of the valve 60. At this time, valve 74 is open and valve 75 is closed. At the same time, the ignitor 64 is activated by the means 65 and ignites the wash gas and wax vapors. Since wax vapors ignite combust with different color flames than a wash gas such as hydrogen, the color of the flame at the exhaust valve 60 provides visual signal of the completion of the dewax or presinter step.

At the end of the dewax step, the temperature within the furnace chamber 32 is approximately 400° C. and, at this time, the outside surface of the furnace walls is maintained by the thermal conductivity of the hydrogen in conjunction with the vapor barrier at a temperature greater than the vaporization temperature of the wax. Consequently, the wax cannot condense on the outside surface of the furnace walls. Instead, the vaporized wax is either condensed against the pressure vessel walls 10 or combusted at the exhaust valve 60.

Following the presinter or dewax step and the complete elimination of the wax from the preforms as described above, the pressure chamber 12 as well as the furnace chamber 32 are evacuated by opening the valve 74 and 75 and activating the vacuum pump 78. At the same time, the temperature of the water flowing through the water jacket 88 is lowered which cools the vessel 10 below the solidification point of the wax thus "freezing" the wax against the walls of the vessel 10. Any wax vapor remaining intermixed with the hydrogen within the pressure vessel 12 is condensed by the condensation means 76 in order to protect the vacuum pump 78 in the well known fashion.

Following the evacuation of the pressure chamber 12 and the solidification of the wax on the vessel walls 11, the heating elements are further energized to heat the furnace chamber 32 up to sintering or liquid phase temperature, typically 1,200°–1,500° C. The furnace chamber is maintained at this elevated temperature for the time period necessary to obtain the proper microstructure development and densification of the parts. Furthermore, throughout the sintering step, the vessel walls 11 are maintained below the vaporization temperature and preferably below the solidification temperature of the wax to prevent revaporization of the wax.

Following the sintering step, the shut off valve 64 is closed and the pressure vessel chamber 12 is pressurized with an inert gas, such as argon, from the inert gas source 90 to a relatively low pressure of 50–1,000 psi and the furnace chamber 32 is heated to an elevated sintering or liquid phase temperature of the parts. Such relatively low pressure in comparison with the HIP process further densifies the parts to nearly 100% theoretical density and, in doing so, emulates a HIP process.

Following pressurization of the pressure vessel 10, the furnace 12 is cooled and depressurized and the parts are removed from the furnace chamber 32.

The present invention thus provides a device for performing presintering, sintering and emulating an HIP process within a single furnace chamber. This completely eliminates any contamination of the parts as would otherwise occur if the parts were transferred from one furnace chamber and to another. Furthermore, by maintaining the exterior of the furnace walls at a temperature greater than the vaporization temperature of the wax during the presinter step, contamination of the parts during the sinter or HIP process by revaporized wax is completely eliminated.

The vapor barrier 44 provided in the side, end and top walls of the furnace 32 effectively eliminates convection currents within the furnace and enables the very high temperatures necessary for both the sinter and HIP process to be achieved with relatively low power consumption. The relatively thick, i.e., effective, insulation used in the furnace walls further reduces the electrical power consumption by the heating element during the sinter and HIP steps.

A still further unique feature of the device according to the present invention is that the hydrogen is directly introduced into the furnace chamber 32 by the distribution tube 44. This construction not only forces the vaporized wax downwardly through the bottom wall of the furnace in the desired fashion but washes or creates the positive removal of impurities from the furnace chamber.

Although the furnace has been described as generally rectangular in construction, it will be understood that other constructions and shapes of the furnace can be employed without deviation from the spirit or scope of the invention. Consequently, the term "side and/or end walls" shall mean substantially all of the furnace walls except the bottom wall 26.

Likewise, although in the preferred form of the invention, a wash gas is used during the dewax step to force the vaporized wax outwardly through the bottom wall 26 of the furnace, it will be understood that vacuum pumping can be alternatively used. In this event, it may be necessary to use other means, such as auxiliary heaters, to maintain the temperature of the outside of the furnace walls at a temperature greater than the condensation temperature of the wax during the dewax step.

Having described my invention, however, still further modifications thereto will become apparent to those skilled in the art to which it pertains without deviation from the spirit of the invention as defined by the scope of the appended claims.

I claim:

1. A device for liquid phase sintering of preforms, said preforms initially comprising powdered material cohesively held together by a fugitive binder, said device comprising:

a pressure vessel defining an interior pressure chamber;

a furnace contained within said pressure chamber, said furnace comprising a top wall, a bottom wall and side and/or end walls which together form a substantially closed furnace chamber, said top wall and each side and/or end wall having a predefined area, each of said furnace walls comprising at least one layer of thermal insulation, said furnace top wall and each of said furnace side and/or end walls comprising a vapor barrier which extends across the entire area of its respective top, side and/or end wall, means for heating said furnace chamber and furnace walls above the vaporization temperature of the fugitive binder, means for enabling a gas to escape through said bottom wall, means for condensating vaporized fugitive binder on the pressure vessel, means for selectively providing access to said furnace chamber, and means for pressurizing said interior pressure chamber.

2. The invention as defined in claim 1 wherein each of said side and/or end walls comprise two layers of insulation and wherein said vapor barrier is sandwiched in between said insulation layers.

3. The invention as defined in claim 1 wherein said bottom wall is constructed of porous insulation and wherein said device comprising means for evacuating said pressure chamber and said furnace chamber.

4. The invention as defined in claim 1 and comprising means for introducing a wash gas directly into said furnace chamber.

5. The invention as defined in claim 4 wherein said introducing means comprises an elongated distribution tube secured within said furnace chamber, said tube having a plurality of axially spaced ports formed along its length and means for supplying said wash gas to said tube.

6. The invention as defined in claim 1 and comprising means for cooling said pressure vessel below the liquification temperature of the fugitive binder.

7. The invention as defined in claim 6 wherein said cooling means comprises a water cooled fluid system in contact with said pressure vessel.

8. A device for liquid phase sintering of preforms, said preforms initially comprising powdered material cohesively held together by a fugitive binder, said device comprising:

a pressure vessel defining an interior pressure chamber;

a furnace contained within the said pressure chamber, said furnace comprising a top wall, a bottom wall and side and/or end walls which together form a substantially closed furnace chamber, each of said furnace walls comprising at least one layer of thermal insulation, said bottom wall being constructed of porous insulation to thereby enable a gas to escape, each of said furnace top, side and/or end walls comprising a vapor barrier, means for heating said furnace chamber and furnace walls above the vaporization temperature of the fugitive binder, means for condensating vaporized fugitive binder on the pressure vesel, means for selectively providing access to said furnace chamber, means for evacuating said pressure chamber to said furnace chamber.

9. The invention as defined in claim 8 wherein each of said side and/or end walls comprises a vapor barrier.

10. The invention as defined in claim 9 wherein said side and/or end walls comprise two layers of insulation and wherein said vapor barrier is sandwiched in between said insulation layers.

11. The invention as defined in claim 8 and comprising means for selectively pressurizing said furnace chamber.

12. A device for liquid phase sintering of preforms, said preforms initially comprising powdered material cohesively held together by a fugitive binder, said device comprising:

a pressure vessel defining an interior pressure chamber;

a furnace contained within said pressure chamber, said furnace comprising a top wall, a bottom wall and side and/or end walls which together form a substantially closed furnace chamber, each of said furnace walls comprising at least one layer of thermal insulation, each of said furnace top, side and/or end walls comprising a vapor barrier, means for heating said furnace chamber and furnace walls above the vaporization temperature of the fugitive binder, means for enabling a gas to escape through said bottom wall, means for condensating vaporized fugitive binder on the pressure vessel, means for selectively providing access to said furnace chamber, means for cooling said pressure vessel below the liquification temperature of the fugitive binder, and wherein said cooling means comprises a water cooled fluid system in contact with said pressure vessel.

13. A device for liquid phase sintering of preforms, said preforms initially comprising powdered material cohesively held together by a fugitive binder, said device comprising:

a pressure vessel defining an interior pressure chamber;

a furnace contained within said pressure chamber, said furnace comprising a top wall, a bottom wall and side and/or end walls which together form a substantially closed furnace chamber, each of said furnace walls comprising at least one layer of thermal insulation, each of said furnace top, and/or end walls comprising a vapor barrier, means for heating said furnace chamber and furnace walls above the vaporization temperature of the fugitive binder, means for enabling a gas to escape through said bottom wall, means for condensating vaporized fugitive binder on the pressure vessel, means for selectively providing access to said furnace chamber, means for introducing a wash gas directly into said furnace chamber, a pressure responsive valve having an inlet open to said pressure chamber and an outlet open exteriorly of said pressure vessel, and means for igniting gases exhausted from said valve outlet.

14. A device for liquid phase sintering of preforms, said preforms initially comprising powdered material cohesively held together by a fugitive binder, said device comprising:

a pressure vessel defining an interior pressure chamber;

a furnace contained within said pressure chamber, said furnace comprising a top wall, a bottom wall and side and/or end walls which together form a substantially closed furnace chamber, said top wall and each side and/or each wall having a predefined area, each of said furnace walls comprising at least one layer of thermal insulation, said furnace top wall and each of said furnace side and/or end walls comprising a vapor barrier which extends across the entire area of its respective top, side and/or end wall, means for heating said furnace chamber and furnace walls above the vaporization temperature of the fugitive binder, means for enabling a gas to escape from said furnace chamber, means for condensating vaporized fugitive binder on the pressure vessel, means for selectively providing access to said furnace chamber, and means for pressurizing said interior pressure chamber.

* * * * *